US010293603B2

(12) United States Patent
Korthuis et al.

(10) Patent No.: US 10,293,603 B2
(45) **Date of Patent: *May 21, 2019**

(54) MULTI-DIRECTIONAL SINGLE PASS PRINTING

(71) Applicant: HEWLETT-PACKARD DEVELOPMENT COMPANY, L.P., Houston, TX (US)

(72) Inventors: Vincent C Korthuis, Corvallis, OR (US); Donald J Milligan, Corvallis, OR (US); Dennis Schloeman, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/898,121

(22) Filed: Feb. 15, 2018

(65) Prior Publication Data

US 2018/0186149 A1 Jul. 5, 2018

Related U.S. Application Data

(63) Continuation of application No. 15/518,950, filed as application No. PCT/US2014/062930 on Oct. 29, 2014, now Pat. No. 9,937,713.

(51) Int. Cl.

| | |
|---|---|
| ***B41J 2/21*** | (2006.01) |
| ***B41J 2/045*** | (2006.01) |
| ***B41J 19/14*** | (2006.01) |

(52) U.S. Cl.

CPC ..... *B41J 2/04546* (2013.01); *B41J 2/04586* (2013.01); *B41J 2/2103* (2013.01); *B41J 19/142* (2013.01); *B41J 19/147* (2013.01)

(58) Field of Classification Search

CPC .. B41J 2/04546; B41J 2/04586; B41J 2/2103; B41J 19/147; H04N 1/6058

USPC ..... 347/5, 9, 14, 40

See application file for complete search history.

(56) References Cited

U.S. PATENT DOCUMENTS

| | | | | |
|---|---|---|---|---|
| 6,354,692 | B1 | 3/2002 | Ross | |
| 6,938,977 | B2 | 9/2005 | Corbin et al. | |
| 6,980,328 | B2 | 12/2005 | Hudson | |
| 8,511,770 | B2 | 8/2013 | Rodriguez | |
| 8,608,283 | B1 | 12/2013 | Phillips et al. | |
| 8,727,493 | B2 * | 5/2014 | Cofler | B41J 25/005 347/12 |

(Continued)

FOREIGN PATENT DOCUMENTS

| | | |
|---|---|---|
| CN | 1136498 | 11/1996 |
| CN | 1986231 | 6/2007 |

*Primary Examiner* — An H Do

(74) *Attorney, Agent, or Firm* — HP Inc.—Patent Department

(57) ABSTRACT

A multi-directional single pass printing apparatus may include a print head comprising a collection of slots. The collection of slots may include a central slot for delivering a central slot fluid type, a first serial arrangement of first slots on a first side of the central slot to deliver a first series of respective fluid types and a second serial arrangement of second slots on a second side of the central slot opposite the first side. The second series of slots are to deliver a second series of respective fluid types, wherein the second series of respective fluid types mirror the first series of respective fluid types with respect to the central slot fluid type.

21 Claims, 4 Drawing Sheets

(56) References Cited

U.S. PATENT DOCUMENTS

| | | | |
|---|---|---|---|
| 2004/0095405 | A1 | 5/2004 | Schloeman et al. |
| 2010/0214597 | A1 | 8/2010 | Hasseler et al. |
| 2013/0063510 | A1 | 3/2013 | Rice et al. |
| 2013/0201256 | A1 | 8/2013 | Fricke et al. |

* cited by examiner

MULTI-DIRECTIONAL SINGLE PASS PRINTING

CROSS REFERENCE TO RELATED APPLICATIONS

The present continuation application claims priority under 35 USC § 120 from co-pending U.S. patent application Ser. No. 15/518,950 filed on Apr. 13, 2017 by Korthuis et al. and entitled MULTI-DIRECTIONAL SINGLE PASS PRINTING, which claims priority under 35 USC § 119 from PCT/US2014/062930 filed on Oct. 29, 2014 by Korthuis et al. and entitled MULTI-DIRECTIONAL SINGLE PASS PRINTING, the full disclosures both of which are hereby incorporate by reference.

BACKGROUND

Inkjet printers typically utilize a print head that includes slots to eject ink onto a print surface. Typically, data from channels is directed to the slots based on a sequence of ink ejection. The slots typically include the ink colors cyan, magenta, yellow, and black.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
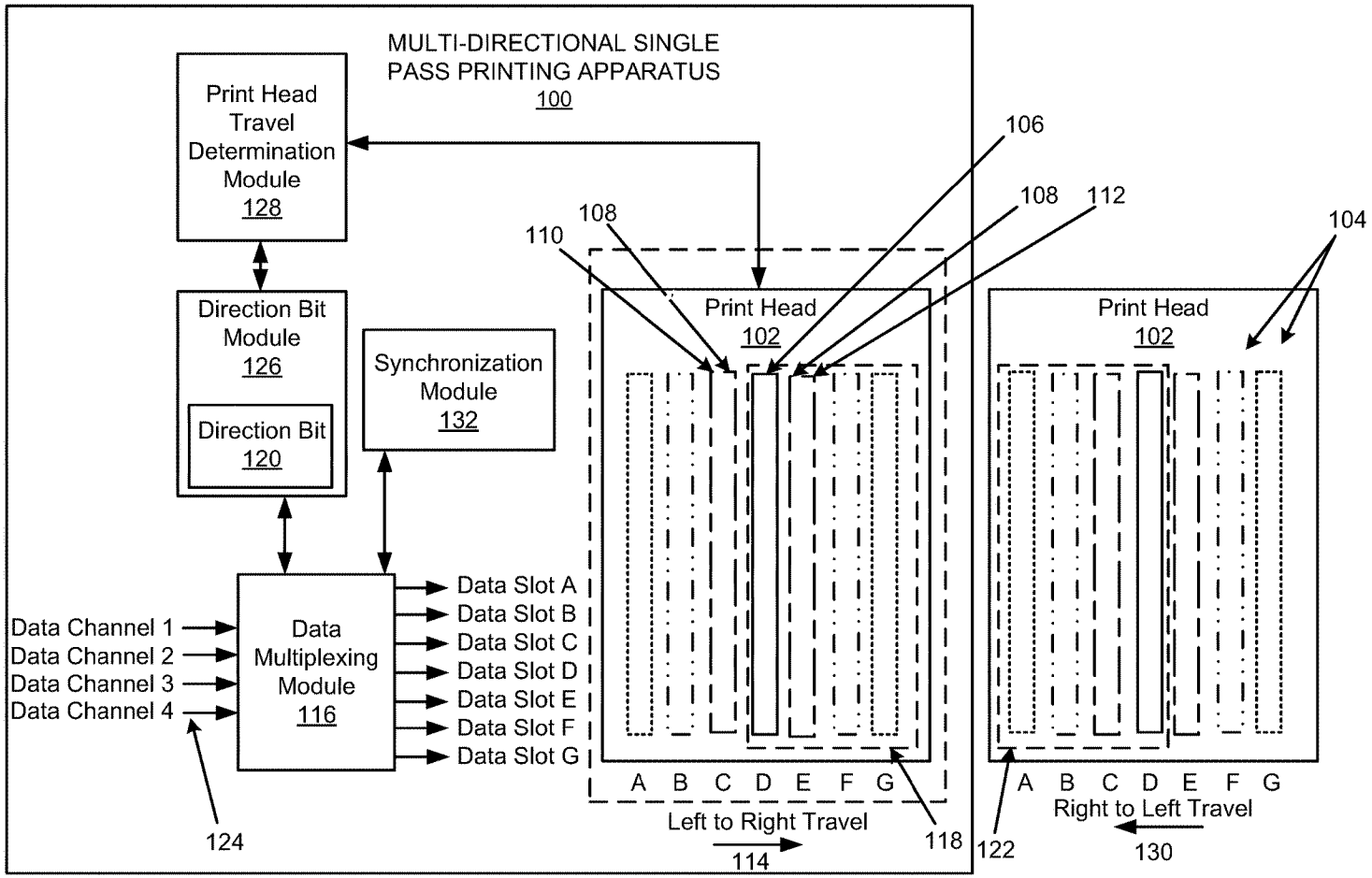
FIG. 1 illustrates an architecture of a multi-directional single pass printing apparatus, according to an example of the present disclosure.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Inkjet printing typically utilizes a print head that includes a plurality of slots to eject ink onto a print surface. Each slot typically ejects an ink of a different color. Data that is forwarded to the slots is typically forwarded from a data channel to a slot. If the number of slots is greater than the number of data channels, the print frequency is typically slowed down to allow the data to fill the additional slots. That is, the data is divided into multiple slots, which increases the number of cycles to load the data into the slots, which further slows down the print frequency. However, slowing down the print frequency also slows down the print speed of the printer.

According to examples, a multi-directional single pass printing apparatus and a method for multi-directional single pass printing are disclosed herein. The apparatus and method disclosed herein generally utilize a direction bit to select which print slot on a print head is to be selected for data loading. For single pass printing, the apparatus and method disclosed herein provide for the dot placement order (e.g., black then yellow then magenta then cyan) to be the same order regardless of the direction of travel of the print head. The apparatus and method disclosed herein provide for the inkjet print head to eject ink in the same order by increasing or duplication of the slots.

The apparatus and method disclosed herein may utilize a data multiplexing module to forward data to an appropriate slot. The data multiplexing module may operate in conjunction with a direction bit module that selects a direction bit based on a direction of travel (e.g., left to right, or right to left) of the print head. For example, if the print head is traveling in a left to right direction and the slot color order from left to right on the print head is C, M, Y, K, Y, M, C, (corresponding to slots A, B, C, D, E, F, G), then a left to right direction bit (e.g., 0) may selects slots D, E, F, and G, that correspond to the dot placement order of K, Y, M, C as the die scans across a coordinate on the print surface of a paper. The inactive slots A, B, and C have no data, may have data value of 0 for each primitive, and do not receive new data when the print head traverses from left to right. When the direction bit changes (e.g., changes to 1) based on the right to left travel of the print head, then slots D, C, B, and A may be selected, and the firing order is once again K, Y, M, C in the right to left direction. Data from the same channel or from low-voltage differential signaling (LVDS) pairs may be forwarded by the data multiplexing module to the appropriate slots. Further, a synchronizer in the data path may reset non selected slots to a zero data value.

The apparatus and method disclosed herein may provide for the firmware (i.e., the machine readable instructions) related to printer to remain the same, regardless of the print mode (e.g., single pass). For example, once the print head travels from left to right, and the ink is ejected onto the print substrate, the print substrate may be advanced before the print head travels from right to left. The firmware thus does not need to keep track of dot placement, and the print substrate may be advanced between each travel of the print head.

The apparatus and method disclosed herein may provide for the number of bond pads to remain the same. For example, based on the increased number of slots, additional bond pads may be needed to add additional channels to forward data to the additional slots. However, for the apparatus and method disclosed herein, since the number of the channels is not increased, the number of bond pads remains the same irrespective of the higher number of slots.

The apparatus and method disclosed herein may provide for the number of channels per slot to remain the same. For example, as disclosed herein, the number of channels per slot remains the same, irrespective of the higher number of slots compared to the number of channels.

The apparatus and method disclosed herein may provide for a single pass print mode in both directions (e.g., left to right, or right to left) while maintaining color order. For example, as disclosed herein, for left to right and for right to left travel of the print head, the dot placement order remains identical (e.g., K, Y, M, C in both directions). The use of the single pass print mode may provide for all of the dots that are needed to be placed on a print substrate to be placed in a single pass of the print head (e.g., a left to right pass). Thus, the right to left pass may be used to place all of the dots that are needed to be placed on the print substrate to be placed in another single pass of the print head. For the apparatus and method disclosed herein, the aspect of the single pass print mode may thus effectively double print speed, as opposed to the use of two passes to print a set of dots on the print substrate.

The apparatus and method disclosed herein may provide for the same application-specific integrated circuit (ASIC) that drives, for example, a four slot print head to be used to drive, for example, a seven slot print head. For example, as disclosed herein, even though the number of slots may be increased (e.g., from four to seven slots), the ASIC that is used for a four slot print head may be similarly used for a seven slot print head since the number of channels that are used to forward data to the slots remains the same.

FIG. 1 illustrates an architecture of a multi-directional single pass printing apparatus 100 (hereinafter also referred to as "apparatus 100"), according to an example of the present disclosure. Referring to FIG. 1, the apparatus 100 is depicted as including a print head 102 including a plurality of slots 104. The slots 104 may be used to eject ink onto a print surface. Although the apparatus 100 is depicted as including the print head 102, the apparatus 100 may instead include the components that control operation of the print head 102. For example, instead of including the print head 102, the apparatus 100 may include a data multiplexing module 116, a direction bit module 126, a print head travel determination module 128, and a synchronization module 132, each of which are described in further detail.

The plurality of slots 104 may include a generally central slot 106 for a first ink color, and two or more additional slots 108. According to an example, the first ink color may include black (i.e., K). According to an example, the additional slots 108 may include six additional slots (i.e., the plurality of slots 104 include seven slots as illustrated in the example of FIG. 1). However, any number of additional slots may be used for the additional slots 108.

A slot 110 of the additional slots 108 may be disposed on a first side of the central slot 106. According to an example, further slots similar to the slot 110 may be disposed on the first side of the central slot 106. Further, another slot 112 of the additional slots 108 may be disposed on a second side of the central slot 106. According to an example, further slots similar to the slot 112 may be disposed on the second side of the central slot 106.

According to an example, the first side may be generally opposite to the second side. The additional slots 108 may include a further ink color that provides a generally mirrored arrangement of ink colors relative to the first ink color. According to an example, the further ink color may include yellow (i.e., Y). Further, for the example of FIG. 1 that illustrates six additional slots, the further ink colors may include Y, magenta (i.e., M), and cyan (i.e., C). For the example of FIG. 1, although the slot colors are ordered as C, M, Y, K, Y, M, C in the left to right direction of travel 114 for the print head 102 (i.e., the left to right direction in the orientation of FIG. 1), the slot colors may be ordered in a variety of different configurations (e.g., Y, M, C, K, C, M, Y, etc.).

The data multiplexing module 116 may forward data to a set of slots 118 of the plurality of slots 104 when a direction bit 120 related to the print head 102 is set to a first value (e.g., 0). The data multiplexing module 116 may forward the data to another set of slots 122 of the plurality of slots 104 when the direction bit 120 is set to a second value (e.g., 1). According to an example, the data multiplexing module 116 may include a data multiplexer to forward data to the set of slots 118 or to the set of slots 122. According to an example, the data multiplexing module 116 may be implemented on the die of the print head Silicon.

The data multiplexing module 116 may include a plurality of channels 124 to forward the data to the plurality of slots 104. For the example of FIG. 1, the plurality of channels 124 may be less than the plurality of slots 104. For the example of FIG. 1, the data multiplexing module 116 may include four input channels 124 that are labeled as 1, 2, 3, and 4, that multiplex data to the plurality of slots 104 that are labeled as A, B, C, D, E, F, and G (i.e., to the set of slots 118 or to the set of slots 122).

The direction bit 120 may be set by the direction bit module 126. The direction bit module 126 may operate in conjunction with the print head travel determination module 128 to determine a direction of travel of the print head 102. The first value (e.g., 0) of the direction bit 120 may correspond to a direction of travel of the print head (e.g., the left to right direction of travel 114). Further, the second value (e.g., 1) of the direction bit 120 may correspond to a generally opposite direction of travel of the print head (e.g., a right to left direction of travel 130).

The synchronization module 132 may load a zero data value in an inactive slot of the plurality of slots. The synchronization module 132 may include a Csync, or other such synchronizers to load a zero data value in an inactive slot of the plurality of slots. For example, for the left to right direction of travel 114 for the print head 102 during which the slots D, E, F, and G are selected based on the first value (e.g., 0) of the direction bit 120, the synchronization module 132 may load a zero data value in the inactive slots A, B, and C. Similarly, for the right to left direction of travel 130 for the print head 102 during which the slots D, C, B, and A are selected based on the second value (e.g., 1) of the direction bit 120, the synchronization module 132 may load a zero data value in the inactive slots E, F, and G.

Based on the first value (e.g., 0) of the direction bit 120 or the second value (e.g., 1) of the direction bit 120, the data for operating the print head 102 may be respectively forwarded to the set of slots (e.g., D, E, F, and G) or to the set of slots (e.g., D, C, B, and A) in a same specified data order. For example, for the example of FIG. 1, based on the first value (e.g., 0) of the direction bit 120, the data may be forwarded to the set of slots (e.g., D, E, F, and G) in a specified data order of D, E, F, and G, which respectively represent data for the ink colors K, Y, M, and C. Further, for the example of FIG. 1, based on the second value (e.g., 1) of the direction bit 120, the data may be forwarded to the set of slots (e.g., D, C, B, and A) in the same specified data order of D, C, B, and A, which also respectively represent data for the ink colors K, Y, M, and C.

With respect to a printer that uses the apparatus 100, the machine readable instructions related to operation of the printer may be modified for operating the apparatus 100 (e.g., dividing the slots of the print head 102 into the set of slots D, E, F, and G, or the set of slots D, C, B, and A. However, the machine readable instructions related to placement of ink dots in the correct order may be based on the direction bit 120 and the layout of the apparatus 100 to provide for a correct ink dot placement order (e.g., divide the slots 104 into a set of slots D, E, F, and G, or D, C, B, and A, by changing the direction bit 120).

Figure 2:
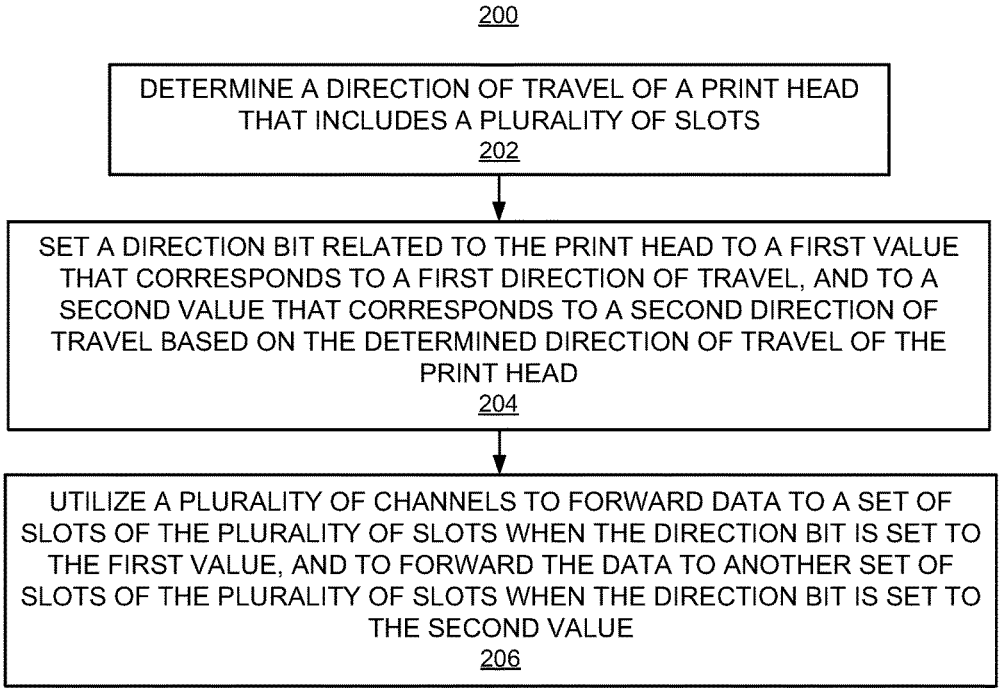
FIG. 2 illustrates a method for multi-directional single pass printing, according to an example of the present disclosure.
Figure 3:
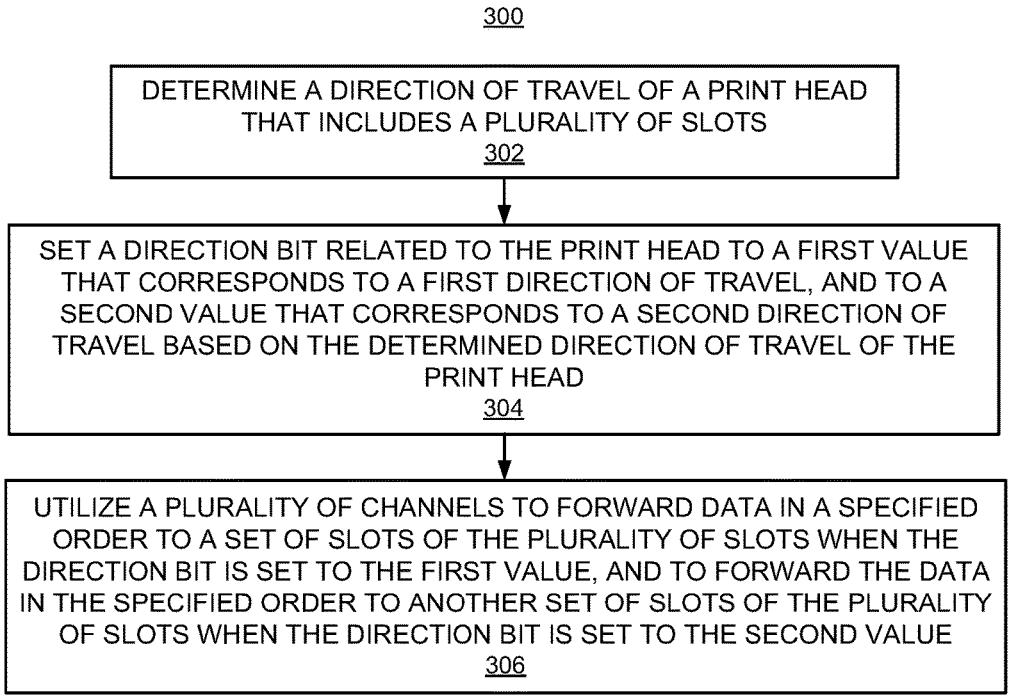
FIG. 3 illustrates further details of the method for multi-directional single pass printing, according to an example of the present disclosure.

FIGS. 2 and 3 respectively illustrate flowcharts of methods 200 and 300 for multi-directional single pass printing, corresponding to the example of the apparatus 100 whose construction is described in detail above. The methods 200 and 300 may be implemented on the apparatus 100 with reference to FIGS. 1 and 2 by way of example and not limitation. The methods 200 and 300 may be practiced in other apparatus.

Referring to FIG. 2, for the method 200, at block 202, the method may include determining a direction of travel of a print head that includes a plurality of slots. For example, referring to FIG. 1, the print head travel determination module 128 may determine a direction of travel of the print head 102. The first value (e.g., 0) of the direction bit 120 may correspond to a direction of travel of the print head (e.g., the left to right direction of travel 114). Further, the second value (e.g., 1) of the direction bit 120 may correspond to a generally opposite direction of travel of the print head (e.g., the right to left direction of travel 130). The plurality of slots 104 may include a first slot 106 for a first ink color, and two or more additional slots 108. A slot 110 of the two or more additional slots 108 may be disposed on a first side of the first slot 106, and another slot 112 of the two or more additional slots 108 may be disposed on a second side of the first slot 106. The first side may be generally opposite to the second side, and the two or more additional slots 108 may include a further ink color that provides a generally mirrored arrangement of ink colors relative to the first ink color.

At block 204, the method may include setting a direction bit related to the print head to a first value that corresponds to a first direction of travel, and to a second value that corresponds to a second direction of travel based on the determined direction of travel of the print head. For example, referring to FIG. 1, the direction bit module 126 may set the direction bit 120 related to the print head 102 to a first value (e.g., 0) that corresponds to a first direction of travel, and to a second value (e.g., 1) that corresponds to a second direction of travel based on the determined direction of travel of the print head 102.

At block 206, the method may include utilizing a plurality of channels to forward data to a set of slots of the plurality of slots when the direction bit is set to the first value, and to forward the data to another set of slots of the plurality of slots when the direction bit is set to the second value, where the plurality of channels may be less than the plurality of slots. For example, referring to FIG. 1, the data multiplexing module 116 may utilize a plurality of channels 124 to forward data to a set of slots 118 of the plurality of slots 104 when the direction bit 120 is set to the first value (e.g., 0), and to forward the data to another set of slots 122 of the plurality of slots 104 when the direction bit 120 is set to the second value (e.g., 1). As shown in FIG. 1, the plurality of channels 124 may be less than the plurality of slots 104.

According to an example, for the method 200, utilizing a plurality of channels to forward data to a set of slots of the plurality of slots when the direction bit is set to the first value, and forwarding the data to another set of slots of the plurality of slots when the direction bit is set to the second value may further include forwarding the data to the set of slots and to the another set of slots in a same specified data order.

Referring to FIG. 3, for the method 300, at block 302, the method may include determining a direction of travel of a print head that includes a plurality of slots. For example, referring to FIG. 1, the print head travel determination module 128 may determine a direction of travel of the print head 102. The first value (e.g., 0) of the direction bit 120 may correspond to a direction of travel of the print head (e.g., the left to right direction of travel 114). Further, the second value (e.g., 1) of the direction bit 120 may correspond to a generally opposite direction of travel of the print head (e.g., the right to left direction of travel 130). The plurality of slots 104 may include a first slot 106 for a first ink color, and two or more additional slots 108. A slot 110 of the two or more additional slots 108 may be disposed on a first side of the first slot 106, and another slot 112 of the two or more additional slots 108 may be disposed on a second side of the first slot 106. The first side may be generally different than the second side, and the two or more additional slots 108 may include a further ink color.

At block 304, the method may include setting a direction bit related to the print head to a first value that corresponds to a first direction of travel, and to a second value that corresponds to a second direction of travel based on the determined direction of travel of the print head. For example, referring to FIG. 1, the direction bit module 126 may set the direction bit 120 related to the print head 102 to a first value (e.g., 0) that corresponds to a first direction of travel, and to a second value (e.g., 1) that corresponds to a second direction of travel based on the determined direction of travel of the print head 102.

At block 306, the method may include utilizing a plurality of channels to forward data in a specified order to a set of slots of the plurality of slots when the direction bit is set to the first value, and to forward the data in the specified order to another set of slots of the plurality of slots when the direction bit is set to the second value, where the plurality of channels may be less than the plurality of slots. For example, referring to FIG. 1, the data multiplexing module 116 may utilize a plurality of channels 124 to forward data in a specified order to a set of slots 118 of the plurality of slots 104 when the direction bit 120 is set to the first value (e.g., 0), and to forward the data in the specified order to another set of slots 122 of the plurality of slots 104 when the direction bit 120 is set to the second value (e.g., 1).

Figure 4:
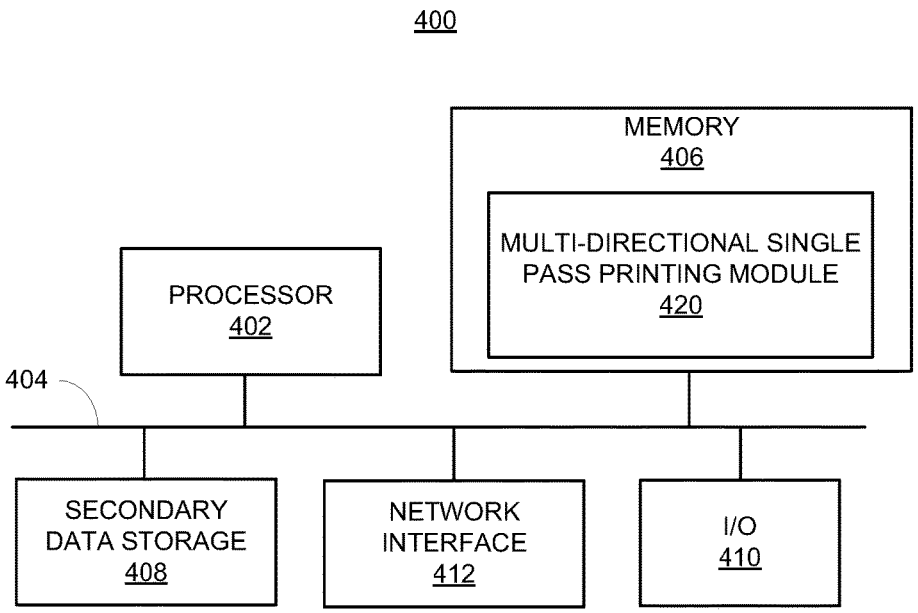
FIG. 4 illustrates a computer system, according to an example of the present disclosure.

FIG. 4 shows a computer system 400 that may be used with the examples described herein. The computer system 400 may represent a generic platform that includes components that may be in a server or another computer system. The computer system 400 may be used as a platform for the apparatus 100. The computer system 400 may execute, by a processor (e.g., a single or multiple processors) or other hardware processing circuit, the methods, functions and other processes described herein. These methods, functions and other processes may be embodied as machine readable instructions stored on a computer readable medium, which may be non-transitory, such as hardware storage devices (e.g., RAM (random access memory), ROM (read only memory), EPROM (erasable, programmable ROM), EEPROM (electrically erasable, programmable ROM), hard drives, and flash memory).

The computer system 400 may include a processor 402 that may implement or execute machine readable instructions performing some or all of the methods, functions and other processes described herein. Commands and data from the processor 402 may be communicated over a communication bus 404. The computer system may also include a main memory 406, such as a random access memory (RAM), where the machine readable instructions and data for the processor 402 may reside during runtime, and a secondary data storage 408, which may be non-volatile and stores machine readable instructions and data. The memory and data storage are examples of computer readable mediums. The memory 406 may include a multi-directional single pass printing module 420 including machine readable instructions residing in the memory 406 during runtime and executed by the processor 402. The multi-directional single pass printing module 420 may include the modules of the apparatus 100 shown in FIGS. 1 and 2.

The computer system 400 may include an I/O device 410, such as a keyboard, a mouse, a display, etc. The computer system may include a network interface 412 for connecting to a network. Other known electronic components may be added or substituted in the computer system.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A multi-directional single pass printing apparatus comprising:

a print head comprising a collection of slots, the collection of slots comprising:

a central slot for delivering a central slot fluid type;

a first serial arrangement of first slots on a first side of the central slot to deliver a first series of respective fluid types; and a second serial arrangement of second slots on a second side of the central slot opposite the first side, the second series of slots to deliver a second series of respective fluid types, the second series of respective fluid types mirroring the first series of respective fluid types with respect to the central slot fluid type.

2. The multi-directional single pass printing apparatus according to claim 1, wherein the collection of slots comprises seven slots, and wherein the central slot fluid type is a black ink.

3. The multi-directional single pass printing apparatus according to claim 2, wherein the first series of respective fluid types and the second series of respective fluid types each comprise cyan, magenta, and yellow inks.

4. The multi-directional single pass printing apparatus according to claim 1 further comprising:

a data multiplexer to forward data to the first serial arrangement of slots and the central slot when a direction bit related to the print head is set to a first value, and to forward the data to the second serial arrangement of slots and the central slot when the direction bit is set to a second value, wherein the data multiplexer includes a number of data forwarding channels less than the collection of slots.

5. The multi-directional single pass printing apparatus according to claim 4, wherein the first value of the direction bit corresponds to a direction of travel of the print head, and the second value of the direction bit corresponds to a generally opposite direction of travel of the print head.

6. The multi-directional single pass printing apparatus according to claim 4, further comprising a synchronizer to load a zero data value in an inactive slot of the collection of slots.

7. The multi-directional single pass printing apparatus according to claim 1, further comprising:

a fluid of the central slot fluid type deliverable by the central slot;

a first series of fluids of the respective fluid types deliverable by the first serial arrangement of first slots; and a second series of fluid of the respective fluid types deliverable by the second serial arrangement of second slots.

8. A method for multi-directional single pass printing, the method comprising:

ejecting different fluid types in an order from a first set of respective slots on a print head during a first pass of the printhead traveling in a first direction; and ejecting the different fluid types in the order from a second set of respective slots on a printhead during a second pass of the printhead traveling in a second direction opposite the first direction, wherein the first set of respective slots and the second set of respective slots share a slot.

9. The method according to claim 8, wherein the first set of slots comprises a central slot for delivering a central slot fluid type and a first serial arrangement of slots for delivering a first series of the different fluid types; and wherein the second set of slots comprises the central slot and a second serial arrangement of slots for delivering a second series of the different fluid types, the second series of fluid types mirroring the first series of fluid types with respect to the central slot fluid type.

10. The method according to claim 9, wherein the slot shared by the first set of respective slots and the second set of respective slots is to deliver a black ink.

11. The method according to claim 10, wherein the first series of fluid types and the second series of fluid types each comprise cyan, magenta and yellow inks.

12. The method according to claim 8 further comprising:

setting a direction bit related to the print head to a first value that corresponds to the first direction of travel, and to a second value that corresponds to the second direction of travel; and utilizing channels to forward data to the first set of slots, and to forward the data to the second set of slots when the direction bit is set to the second value, wherein the channels is less than a total number slots forming the first set of slots and the second set of slots.

13. The method for multi-directional single pass printing according to claim 12, wherein utilizing channels to forward data to the first set of slots when the direction bit is set to the first value, and forwarding the data to the second set of slots when the direction bit is set to the second value further comprises:

forwarding the data to the first set of slots and to the second set of slots in a same specified data order.

14. The method for multi-directional single pass printing according to claim 12, further comprising:

loading a zero data value in an inactive slot of the slots.

15. The method for multi-directional single pass printing according to claim 12, wherein utilizing a plurality of channels to forward data to the first set of slots when the direction bit is set to the first value, and to forward the data to the second set of slots when the direction bit is set to the second value further comprises:

utilizing the plurality of channels of a data multiplexer to forward the data to the first set of slots when the direction bit is set to the first value, and to forward the data to the second set of slots when the direction bit is set to the second value.

16. The method for multi-directional single pass printing according to claim 8, wherein the first set of slots comprises four slots, and wherein the second set of slots comprises four slots.

17. A non-transitory computer readable medium having stored thereon machine readable instructions to provide multi-directional single pass printing, the machine readable instructions, when executed, cause a processor to output control signals causing a print head to:

eject different fluid types in an order from a first set of respective slots on a print head during a first pass of the printhead traveling in a first direction; and eject the different fluid types in the order from a second set of respective slots on a printhead during a second pass of the printhead traveling in a second direction opposite the first direction, wherein the first set of respective slots and the second set of respective slots share a slot.

18. The non-transitory computer-readable medium according to claim 17, wherein the machine-readable instructions, when executed, further cause the processor to:

determine a direction of travel of the print head;

set a direction bit related to the print head to a first value that corresponds to the first direction of travel, and to a second value that corresponds to the second direction of travel based on the determined direction of travel of the print head; and utilize a plurality of channels to forward data in a specified order to the first set of slots when the direction bit is set to the first value, and to forward the data in the specified order to the second set of slots when the direction bit is set to the second value, wherein the channels is less than a total number slots forming the first set of slots and the second set of slots.

19. The non-transitory computer-readable medium of claim 17, wherein the first set of slots comprises a central slot for delivering a central slot fluid type and a first serial arrangement of slots for delivering a first series of the different fluid types; and wherein the second set of slots comprises the central slot and a second serial arrangement of slots for delivering a second series of the different fluid types, the second series of fluid types mirroring the first series of fluid types with respect to the central slot fluid type.

20. The non-transitory computer-readable medium of claim 19, wherein the slot shared by the first set of respective slots and the second set of respective slots is to deliver a black ink.

21. The non-transitory computer-readable medium of claim 20, wherein the first series of fluid types and the second series of fluid types each comprise cyan, magenta and yellow inks.

* * * * *